US006045122A

United States Patent [19]

Torres

[11] Patent Number: 6,045,122

[45] Date of Patent: Apr. 4, 2000

[54] SAFETY VEHICLE LIFT

[76] Inventor: Manuel Torres, 44601 17th St. East, Lancaster, Calif. 93535

[21] Appl. No.: 09/020,635

[22] Filed: Feb. 9, 1998

Related U.S. Application Data

[63] Continuation-in-part of application No. 08/714,628, Sep. 16, 1996, Pat. No. 5,716,040.

[51] Int. Cl.[7] ..... E02C 3/00

[52] U.S. Cl. ..... 254/88; 254/122; 254/126

[58] Field of Search ..... 254/88, 122, 126, 254/7 B, 7 R

[56] References Cited

U.S. PATENT DOCUMENTS

| | | | |
|---|---|---|---|
| 3,305,876 | 2/1967 | Hutt | 254/126 |
| 3,870,277 | 3/1975 | West | 254/88 |
| 4,341,371 | 7/1982 | Rotella | 254/88 |
| 4,405,116 | 9/1983 | Eisenberg | 254/122 |
| 5,503,368 | 4/1996 | Torres | 254/88 |

*Primary Examiner*—Robert C. Watson
*Attorney, Agent, or Firm*—Richard L. Huff

[57] ABSTRACT

A safety vehicle lift having a base, a lifting assembly, a drive mechanism, a handle, and a ramp. The base is made of flat rigid construction which may be in one or two sections and may be of solid or grated construction. When in two sections, the sections may be permanently abutted with a hinge or may be temporarily abutted with conventional locking mechanisms. The base contains retractable wheels. The base is wider than the structures supported by the base. A drive mechanism is made up of a jackscrew passing through a threaded cross brace. When the jackscrew is turned manually or mechanically, there is a raising or lowering of the support platform. The lift is provided with a ramp having side walls and leading from the level of the base to the level of the support base. The ramp may be of solid or grated construction. The lift has less weight and equivalent strength compared to prior lifts, thus improving mobility. As the base is grated, the lift may be used on a wide variety of surfaces. The retractable wheels add mobility while maintaining safety. As the base is wider than the lifting mechanism and the ramp, greater stability is maintained.

9 Claims, 6 Drawing Sheets

SAFETY VEHICLE LIFT

CROSS-REFERENCE TO RELATED APPLICATIONS

This application is a continuation-in-part of Ser. No. 08/714,628, file Sep. 16, 1996 now U.S. Pat. No. 5,716,040.

BACKGROUND OF THE INVENTION

1. Field of the Invention

The present invention relates to an improved safety vehicle lift which enables the user to easily transport it and to use it on a variety of surfaces.

2. Description of the Related Art

My invention disclosed in Ser. No. 08/714,628 is an improvement over the invention disclosed and claimed in U.S. Pat. No. 5,503,368. That patent is directed to a safety vehicle lift having a unitary flat base; a lifting assembly comprising a lower portion secured to the base, a support platform above the lower portion, and crosslinkage elements disposed between the lower portion and the support platform; a drive mechanism coupled to the crosslinkage elements containing a jackscrew and a cross brace operably connected to the jackscrew in such a manner that when the jackscrew is rotated the cross brace is forced forwardly or rearwardly to cause the crosslinkage elements to raise or lower the support platform; a handle attached to the jackscrew to rotate the jackscrew; and a ramp leading from the base to the support platform.

Ser. No. 08/714,628, which is incorporated herein by reference, was an improvement over the former invention in that it provided increased smoothness of operation, greater strength and greater protection against the possibility of the vehicle sliding or rolling from the device.

SUMMARY OF THE INVENTION

The present invention is directed to an improvement over my invention disclosed in Ser. No. 08/714,628. The invention set forth in Ser. No. 08/714,628 was directed to a safety vehicle lift comprising (a) a unitary base of a flat rigid construction; (b) a lifting assembly comprising (i) a lower portion secured to the base, (ii) a support platform above the lower portion, and (iii) crosslinkage elements having axially shiftable lower ends coupling the support platform and the lower portion in a scissors-like configuration; (c) a drive mechanism operatively coupled to the crosslinkage elements comprising a jackscrew with a threaded exterior surface and a cross brace with a threaded interior aperture centrally thereof coupled to the jackscrew and to the axially shiftable lower ends of the crosslinkage elements; (d) a rotatable handle coupled to the jackscrew; and (e) a ramp having a lower end at the front edge of the base and a raised end adjacent to the front edge of the support platform in which: the support platform had a rearward end with an upturned edge, two side edges with upturned walls and a forward end with an upturned wall. This arrangement offered added protection against slipping and rolling compared to the above-mentioned patent.

In the invention of Ser. No. 08/714,628, each of the crosslinkage elements comprised two parallel bars coupled together. The effect of this improvement was to obtain added strength.

The cross brace of the invention of Ser. No. 08/714,628 was pivotably attached to guide roller supports which were at the opposing ends of the cross brace. The guide rollers had rearward ends which were attached to the cross brace and forward ends which supported a lateral support having opposing ends. At each end of the lateral support there was attached a guide roller which fitted into the horizontally disposed recess of the lower portion in order to effect a more even lift.

The side edges of the ramp had upturned walls to add even more security against slipping or rolling off of the device.

The present invention is an improvement over my earlier inventions in that it maintains the safety features present in those inventions while making the lift device more transportable and versatile. This advantage is brought about by decreasing the weight while maintaining the strength, by making the device suitable to be used on a wider variety of surfaces, by making the device foldable or separable for transportation, and by making the device capable of being rolled so that much lifting is unnecessary.

DESCRIPTION OF THE PREFERRED EMBODIMENTS

Figure 1:
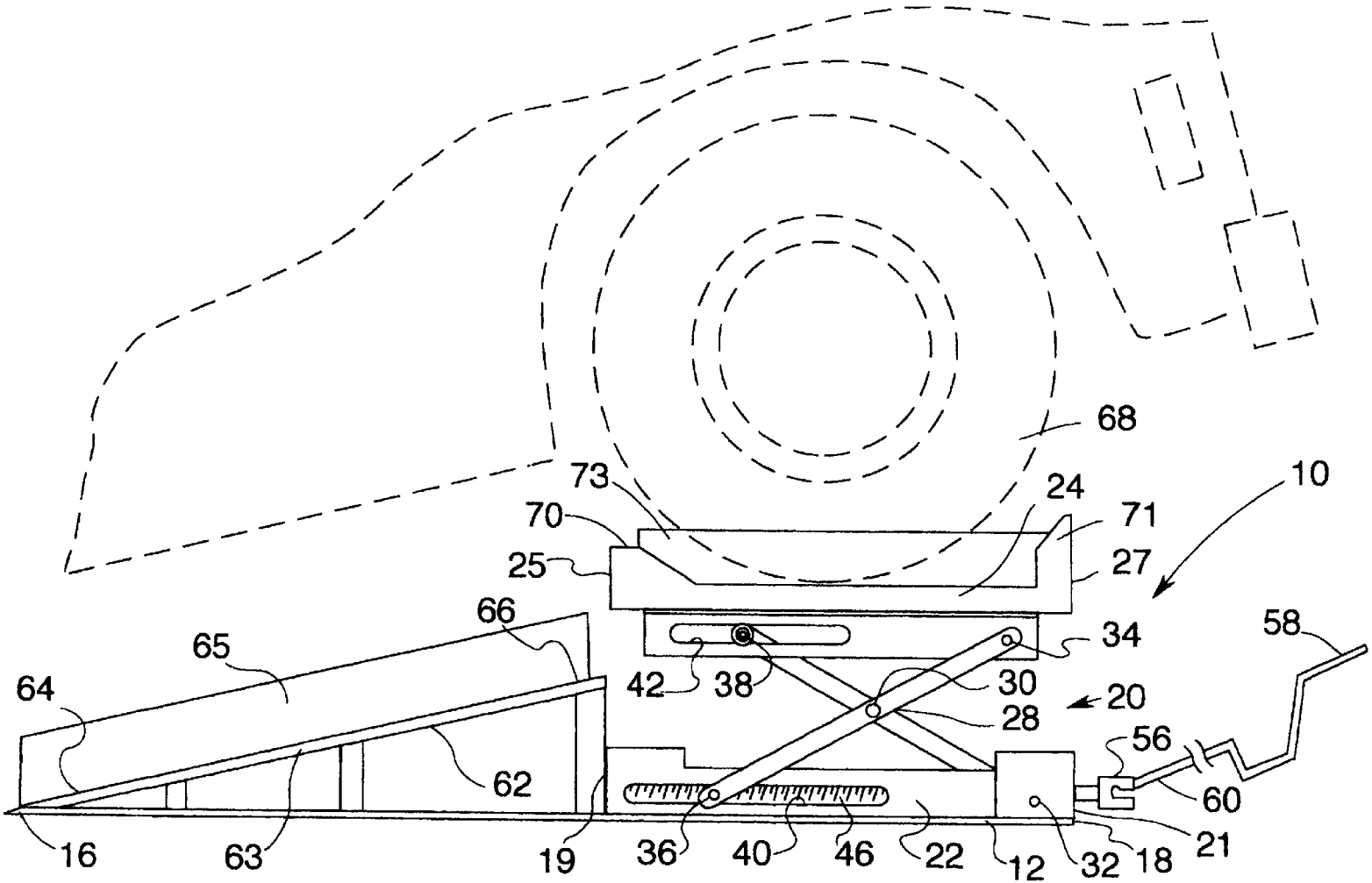
FIG. 1 is a side elevational view of the safety vehicle lift of the present invention with the support platform in a raised position.

The safety vehicle lift of the present invention will now be described with reference to the above drawing. Like elements have like numbers throughout the several Figures.

The safety vehicle lift 10 is a system comprising a base 12, a lifting assembly 20, a drive mechanism, a rotatable handle 56, and a ramp 62.

More specifically, the lift 10 of the present invention contains a base 12 which is of a flat, rigid construction. It may be made of sheet metal, preferably steel. More preferably, the base 12 is made of metal, (preferably steel) and is in the form of a web or grate. This base 12 has substantially the same strength as a solid sheet, yet has the advantage of being lighter in weight. Additionally, the base 12 may be used on non-flat surfaces, such as sand. The base 12 may be unitary for holding together the components which are above it. Preferably, the base 12 is substantially evenly divided, forming a forward base section 11 and a rearward base section 13. These two sections may be permanently attached with a hinge 15 which allows the forward base section 11 to fold to be in abutment with the rearward base section 13 to provide for compactness in transportation. Alternatively, these two sections may be separable and may be temporarily held together with a tongue 43 and groove 44 mating system which may be unsecured or secured with holes and pins 45. Other conventional methods of maintaining two surfaces in abutment are suitable. The base 12 has parallel side edges 14 and parallel front 16 and rear edges 18. To provide for ease of mobility, the base 12 contains a plurality of pairs of wheels 17. The paired wheels may be present between the front edge 16 and the rear edge 18 of the base, preferably up to one third of the length of the base 12 from either end. When the vehicle lift 10 is present in two sections, each section carries a plurality of paired wheels 17. So as to increase the mobility without compromising safety, the wheels 17 are retractable into and through the base 12. This is accomplished by means of conventional spring retraction mechanisms which cause the wheels 17 to extend when there is no weight on the device which is above them and cause the wheels 17 to retract when weight is applied to the device which is above them. The addition of the wheels 17 allows the vehicle lift 10 to be pushed, pulled and steered by an attachment to the rotatable handle 56.

A lifting assembly 20 is secured to base 12. The lifting assembly 20 comprises a lower portion 22 having front 19, rear 21, and side 23 edges. The lower surface of the lower portion 22 is secured to the base 12 between the side edges 14 and adjacent to the rear edge 18. The lifting assembly 20 extends forwardly to about the midpoint of the base 12. Preferably, the base 12 is wider than the ramp 62 and the lifting assembly 20 to increase the stability of the vehicle lift 10.

The lifting assembly 20 also includes a support platform 24 having front 25, rear 27, and side 29 edges and which is positioned above the lower portion 22 and is of a similar length and width as the lower portion 22. The front edge 25 of the support platform 24 has an upturned edge 70. The rear edge 27 of the support platform 24 has an upturned wall 71. The side edges 29 of the support platform 24 have upturned walls 73. These upturned edges and walls prevent supported vehicles from slipping or rolling off of the support platform 24.

The lifting assembly 20 further contains crosslinkage elements 28 which are secured with respect to the upper surface of the base 12 and the lower surface of the support platform 24, Each crosslinkage element 28 comprises two bars 31 coupled together. The crosslinkage elements 28 couple the support platform 24 and the lower portion 22 for relative movement therebetween as caused during the lifting of the support platform 24. The crosslinkage elements 28 are in a scissors-like configuration physically coupled adjacent to their midpoint 30. Similar crosslinkage elements 28 are located adjacent to each side edge 14 of the base 12, lower portion 22, and support platform 24. The crosslinkage elements 28 have pivotal ends 32 34 secured to the lower portion 22 and support platform 24 adjacent to the rearward end 18 above the base 12. The crosslinkage elements 28 also have axially shiftable ends 36 38 secured in horizontally disposed recesses 40 42 in the sides of the lower portion 22 and the support platform 24. Such an arrangement allows for the axially shiftable ends 32 34 to effect parallel movements of the ends 36 38 of the cross linkage elements 28 within the lower portion 22 and the support platform 24.

Drive mechanism 46 is operatively coupled to the crosslinkage elements 28. The drive mechanism 46 comprises a horizontally oriented, centrally disposed jackscrew 47 between the lower portion 22 and the support platform 24. The jackscrew 47 has a threaded exterior surface 48 coupled with a cross brace 49 having a threaded interior aperture 50 centrally thereof. The cross brace 49 is coupled to the jackscrew 47 through the threads 48 for axial movement of the cross brace 49 upon rotation of the jackscrew.

The cross brace 49 has opposite ends 52, which are secured to the axially shiftable ends 36 38 of the cross linkage elements 28 within the lower portion 22 to effect their linear movement in a horizontal direction parallel with the lower portion 22 and the support platform 24. This motion is such as to effect the raising and lowering of the support platform 24 while maintaining its parallelism with respect to the lower portion 22. Guide roller supports 74 are attached to each end 52 of the cross brace 49. Each guide roller support 74 has a forward end 75 and a rearward end 76. The forward end 75 of each guide roller support 74 is attached to the cross brace 49. The rearward end 76 of each guide roller support 74 is attached to a lateral support 77 having opposing ends 78 79. Rotatably mounted to each end 78 79 of the lateral support 77, is a guide roller 80 As the cross brace 49 is urged forwardly or rearwardly, the guide rollers 80 roll forwardly or rearwardly along base 12 to ensure a more even lift when only one side of a vehicle is being lifted.

Figure 2:
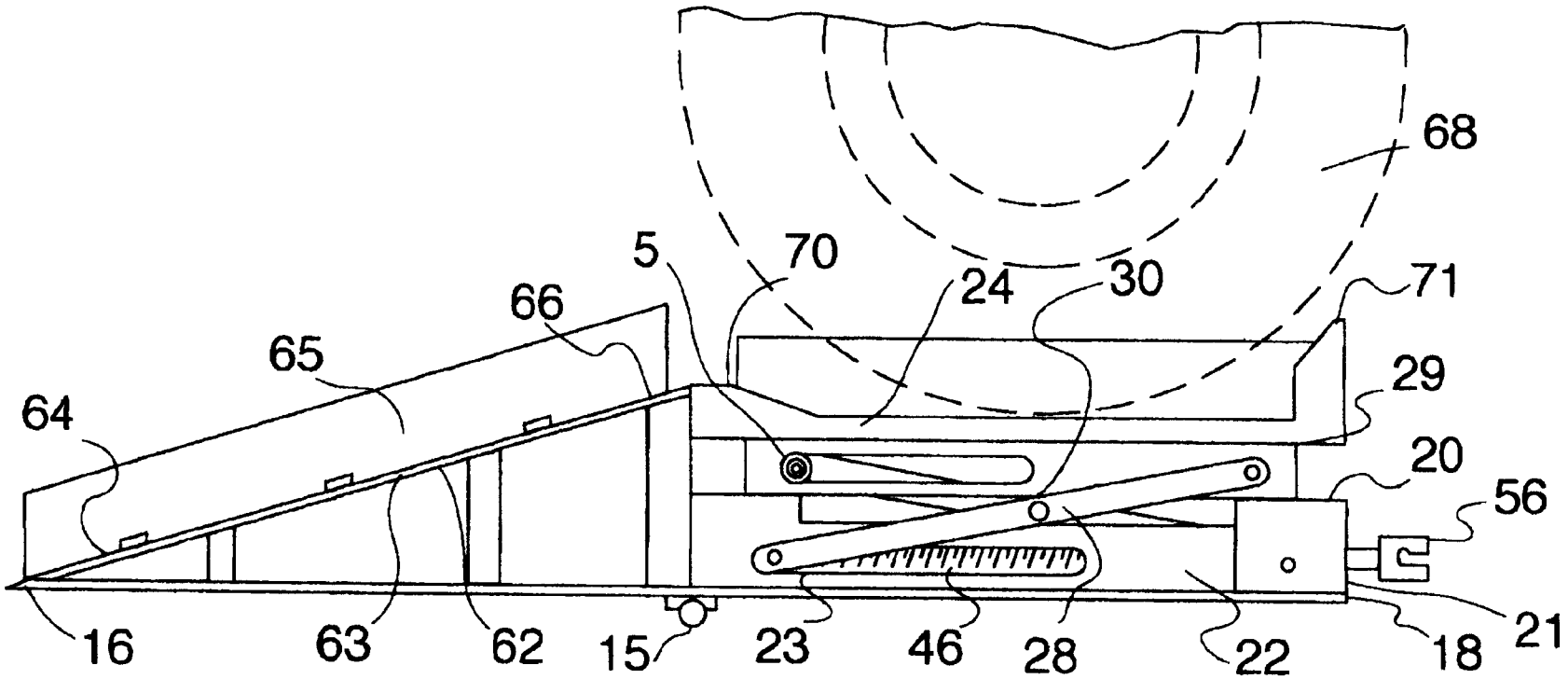
FIG. 2 is a side elevational view of the safety vehicle lift of the present invention with the support platform in a lowered position.
Figure 3:
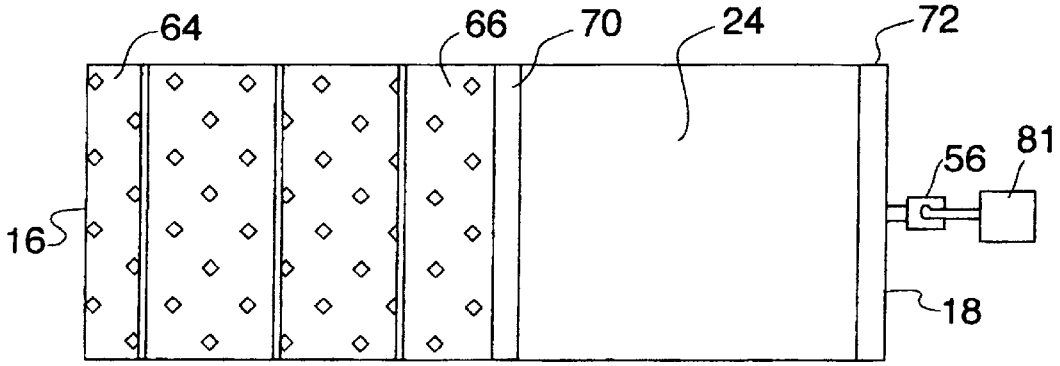
FIG. 3 is a top elevational view of the safety vehicle lift of the present invention.
Figure 4:
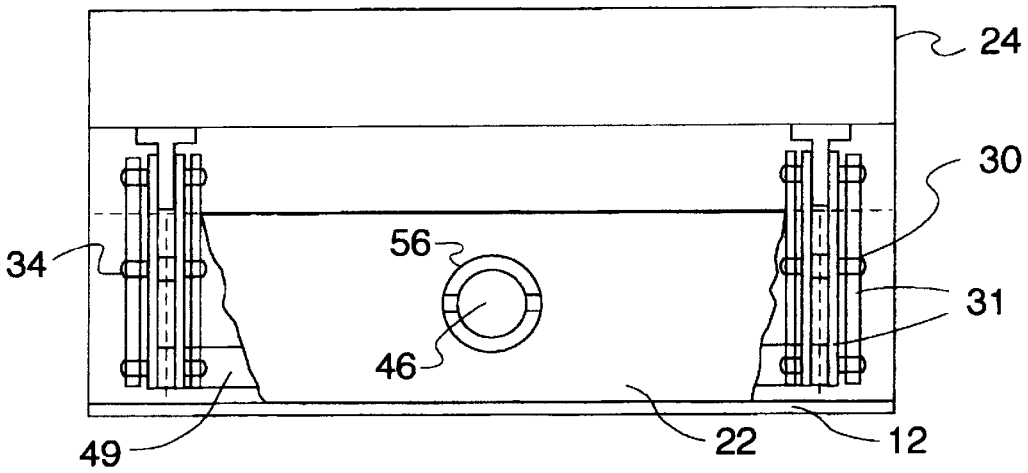
FIG. 4 is a rear elevational view of the safety vehicle lift of the present invention partly in section to show certain construction thereof.
Figure 5:
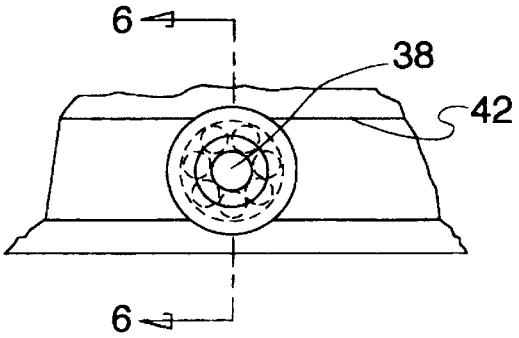
FIG. 5 is a view of the portion of the device taken about circle 5 of FIG. 2.
Figure 6:
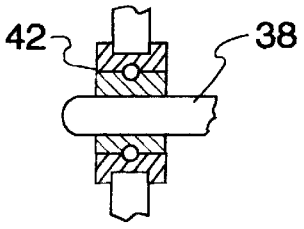
FIG. 6 is a cross-sectional view taken along line 6—6 of FIG. 5.
Figure 7:
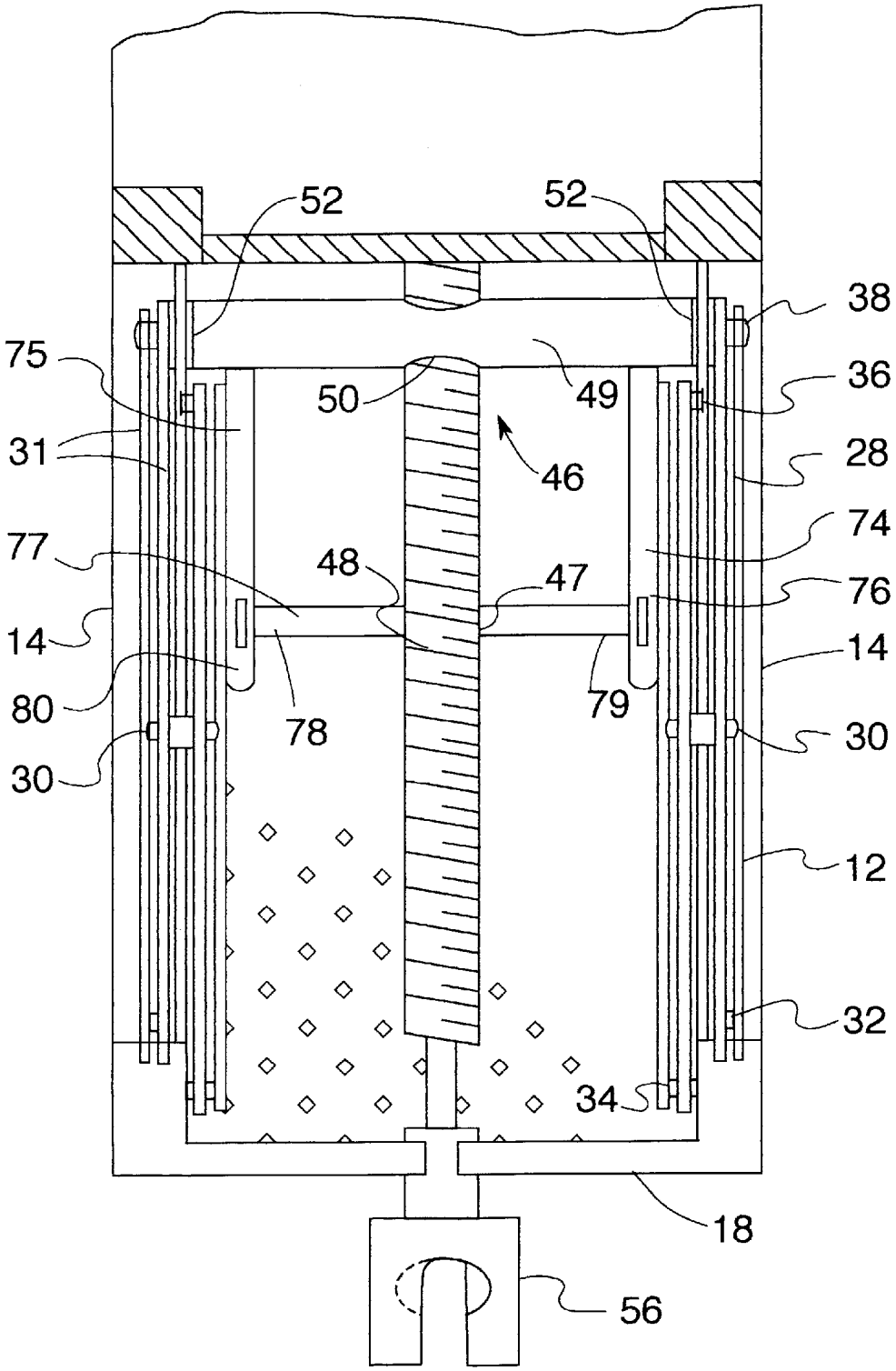
FIG. 7 is a top elevational view of a portion of the safety vehicle lift of the present invention with the support platform removed.
Figure 8:
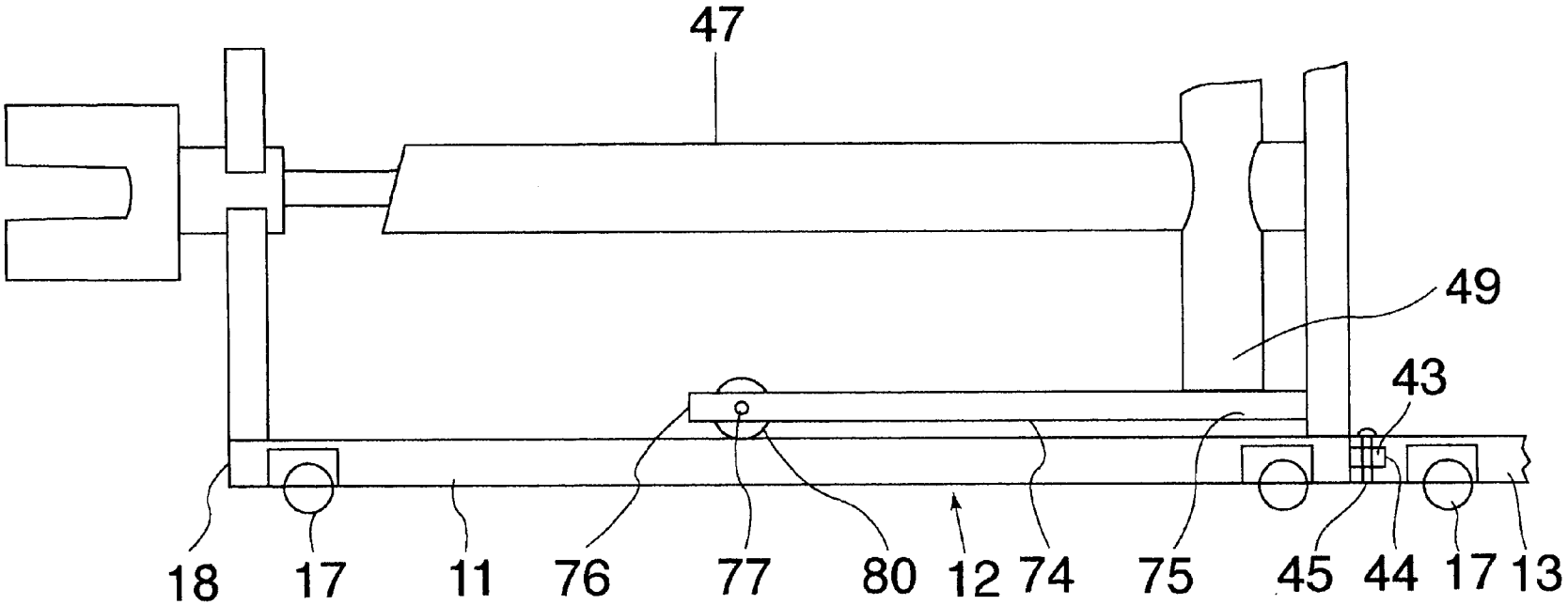
FIG. 8 is a side elevational view showing in detail the relationship between the guide rollers, the guide roller support, and the cross brace.

Rotation of the jackscrew 47 is effected through an operator-controlled socket 56, which socket has an exterior end 58 for being grasped and manipulated by a user. It also has an interior end 60 coupled to the end of the jackscrew 47 over the rear end 18 of the base 12 to effect the desired movement of the support platform 24 between a lower first inoperative orientation as shown in FIG. 2 and a second raised operative orientation as shown in FIG. 1.

The ramp 62 is made of a single sheet of metal, preferably steel, or preferably is made of metal grating or webbing to maintain the strength while decreasing the weight. The ramp 62 has side edges 63 which have upturned walls 65, a lower end 64 near the front end 16 of the base 12, and a raised end 66 at an intermediate position on the base 12, such intermediate position being about halfway between the front edge 16 and the rear edge 18 of the base 12, the lower end 64 and the raised end 66 being integral with the base 12. The ramp 62 has a shallow incline relative to the base 12 so that the raised end 66 of the ramp 62 is located adjacent to the front edge 25 of the support platform 24. This relationship between the ramp 62 and the support platform 24 is such as to allow the tire 68 of a car to be driven up the ramp 62 and onto the support platform 24 when the support platform 24 is in the lower orientation. The upturned walls 65 protect vehicles being driven up the ramp 62 from slipping or rolling from the ramp 62.

The size of the safety vehicle lift 10 is not critical, and may be manufactured to accommodate vehicles ranging in size from subcompact cars to large trucks by varying the length and width of the support platform 24. Generally, the height of the ramp 62 will be between 7 and 15 inches, the length of the ramp 62 will be between 24 and 48 inches or more, and the length of the support platform 24 will be between 16 and 36 inches. The width of the ramp 62 and the support platform 24 will be such as to conveniently hold a single tire or double tires. For large trucks, the length of the base 12 will be at least 60 inches.

In use, the user positions a vehicle so that a tire is directly in front of the ramp 62, drives the vehicle up the ramp 62, and over the raised edge 70 of the support platform 24 onto the surface of the support platform 24. The raised edge 70 and the upturned walls 71 and 73 will prevent longitudinal or sidewise movement of the vehicle. The portion of the vehicle supported by the lift 10 may then be raised and lowered by manually turning the socket 56. Alternatively, the socket 56 may be rotated by use of electrical 81, air, or hydraulic power.

The foregoing is considered as illustrative, only of the principles of the invention and the scope of the invention is to be limited only by the scope of the claimed subject matter.

I claim:

1. A safety vehicle lift comprising:

(a) a base of a flat rigid construction having parallel side edges and having parallel front and rear edges;

(b) a lifting, assembly comprising (i) a lower portion secured to the base between the side edges of the base and adjacent to the rear edge of the base, (ii) a support platform positioned above the lower portion, (iii) crosslinkage elements coupling the support platform and the lower portion in a scissors-like configuration, the lower portion and the support platform having a similar width and length, the lower portion and the support platform each having front, rear, and side edges, the lower portion and the support platform each having horizontally disposed recesses in the side edges thereof, the support platform having a rearward end with an upturned wall, a forward end with an upturned edge, and two side edges with upturned walls, each crosslinkage element comprising two bars coupled together, the crosslinkage elements having two pivotable ends, one of the pivotable ends being secured to the lower portion and another of the pivotable ends being secured to the support platform, each pivotable end further being adjacent to the rearward end of the base, the crosslinkage elements further having axially shiftable ends moveably secured to a respective horizontally disposed recess for parallel movement within the lower portion and the support platform, the crosslinkage element being secured by means of axially shiftable ends;

(c) a drive mechanism operatively coupled to the crosslinkage elements, the drive mechanism including (i) a jackscrew with a threaded exterior surface (ii) a cross brace with a threaded interior aperture centrally thereof coupled to the jackscrew, the cross brace having opposite ends secured to the axially shiftable ends of the crosslinkage elements within the lower portion for linear movement thereof parallel with the lower portion to effect the raising and lowering of the support platform to raised and lowered positions while maintaining its parallelism with the lower portion the opposite ends of the cross brace being coupled to guide rollers which roll along the base upon axial movement of the cross brace;

(d) a rotatable socket being coupled to the jackscrew to effect the desired movement of the support platform; and (e) a ramp having side edges, a lower end near the front edge of the base and a raised end at an intermediate portion of the base between the front edge and the rear edge of the base and being adjacent to the front edge of the support platform, the lower end and the raised end of the ramp being integral with the base, the ramp having a shallow incline relative to the base, the raised end of the ramp being of the same height as the support platform when the support platform is in its lowered position, and the side edges of the ramp having upturned walls.

2. The safety vehicle lift of claim 1, wherein the base comprises two sections of substantially equal length.

3. The safety vehicle lift of claim 2, wherein the two sections are permanently abutted with a hinge.

4. The safety vehicle lift of claim 2, wherein the two sections are temporarily abutted with a locking means.

5. The safety vehicle lift of claim 1, wherein the base contains a plurality of retractable paired wheels.

6. The safety vehicle lift of claim 1, wherein the base is grated or webbed.

7. The safety vehicle lift of claim 1, wherein the ramp is grated or webbed.

8. The safety vehicle lift of claim 1, wherein the base is wider than the ramp and the lift mechanism.

9. The safety vehicle lift of claim 1, wherein the socket is connected to an electric motor.

* * * * *

UNITED STATES PATENT AND TRADEMARK OFFICE

CERTIFICATE OF CORRECTION

PATENT NO. : 6,045,122
DATED : April 4, 2000
INVENTOR(S) : Torres

It is certified that error appears in the above-identified patent and that said Letters Patent is hereby corrected as shown below:

Title page,
Insert -- [*] Notice: Under 35 U.S.C. 154(b), the term of this patent shall be extended for 93 days. --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*